US005914690A

United States Patent [19]

Lehtola et al.

[11] Patent Number: 5,914,690

[45] Date of Patent: Jun. 22, 1999

[54] ANTENNA FOR WIRELESS COMMUNICATIONS DEVICES

[75] Inventors: Antero Lehtola, Turku; Ilkka Pankinaho, Paimio, both of Finland

[73] Assignee: Nokia Mobile Phones Limited, Espoo, Finland

[21] Appl. No.: 09/046,391

[22] Filed: Mar. 23, 1998

[30] Foreign Application Priority Data

Mar. 27, 1997 [FI] Finland ..... 971307

[51] Int. Cl.[6] ..... H01Q 1/24

[52] U.S. Cl. ..... 343/702; 343/700 MS; 343/846

[58] Field of Search ..... 343/702, 700 MS, 343/846, 829, 872, 873, 845, 847, 848; H01Q 1/24

[56] References Cited

U.S. PATENT DOCUMENTS

| | | | |
|---|---|---|---|
| 4,980,694 | 12/1990 | Hines | 343/702 |
| 4,998,078 | 3/1991 | Hulkko | 333/109 |
| 5,181,044 | 1/1993 | Matsumoto et al. | 343/700 MS |
| 5,231,407 | 7/1993 | McGirr et al. | 343/702 |
| 5,341,149 | 8/1994 | Valimaa et al. | 343/895 |
| 5,561,439 | 10/1996 | Moilanen | 343/846 |
| 5,627,550 | 5/1997 | Sanad | 343/700 MS |
| 5,657,028 | 8/1997 | Sanad | 343/700 MS |
| 5,680,144 | 10/1997 | Sanad | 343/700 MS |

*Primary Examiner*—Hoanganh Le

[57] ABSTRACT

The invention relates to an internal antenna (1) for a wireless handportable communication device (2), comprising: an antenna plate (3) fuinctioning as an radiator, a feed element (5) to feed the radiator (3), and attachment elements (10, 12) to attach the antenna (1) to a wireless communications device (2), which comprises an electrically conductive earth plane (4). The attachment elements (10, 12) comprise a cover structure (12) for bracing the antenna plate (3) on the wireless communications device (2). The antenna (1) further comprises a support frame (10) or spacers (21) for keeping the antenna plate (3) at a distance from the earth plane (4).

10 Claims, 5 Drawing Sheets

ANTENNA FOR WIRELESS COMMUNICATIONS DEVICES

BACKGROUND OF THE INVENTION

1. Field of the Invention

The present invention relates to an internal antenna for a wireless handportable communications device and to a mobile handportable containing an internal antenna.

2. Description of the Prior Art

Antennas known to be used in mobile stations for the transmission and reception of radio-frequency signals include the monopole antenna and the helix antenna. In order to guarantee correct electrical operation these antennas have to be located in free space outside the case of the mobile station. The radio-frequency signals between the radio part of the mobile station and the antenna are usually transmitted by means of conductors and connectors.

The monopole antenna is in principle a straight conductor above and substantially perpendicular to a conductive plane and its length depends among other things on the frequency range of the radio-frequency signal used. GSNI mobile communications networks, for example, use the 900-MHz frequency range, in which case the corresponding wavelengths in the air are in the range of 30 cm, approximately. Then the length of the antenna wire, which typically is about $\lambda/2$ for a monopole antenna, should be about 15 cm. In practical implementations the length of the antenna conductor can be shortened to some extent by using a so-called lengthening coil in the matching elements of the antenna. A known prior-art implementation of the monopole antenna in a mobile station is -such that the antenna conductor is placed inside a flexible or rigid and protective tubular piece of insulating material which is further attached to the mobile station by means of a connector. This connector also provides an electrical coupling between the antenna and the radio part of the mobile station. However, such an antenna is long in comparison to the mobile station itself and, placed outside the mobile station, susceptible to being damaged, for example by an impact upon dropping.

Another prior-art implementation of the monopole antenna is a pull-out structure such that the antenna conductor or the like placed inside the body of a mobile station can be pulled out from the mobile station e.g. for the duration of a call. When pulled out to maximum extension the antenna conductor is locked and at the same time electrically coupled to the radio part of the mobile station. After the call the antenna conductor is usually pushed back inside the case of the mobile station. However, when the antenna conductor is fully inside the case of the mobile station the signal amplification is not as good as it would otherwise be, which especially in a weak signal field may cause the connection between the mobile communications system and the mobile station to be cut off. Then the antenna has to be pulled out from the case of the mobile station if the mobile station is to be logged on in the mobile communications system, e.g. to receive incoming calls.

However, such a movable antenna comprises parts that become mechanically worn, so in the course of time there may arise a need to replace at least part of the antenna elements. Likewise, careless handling of the mobile station may damage the antenna conductor especially when being pulled out or pushed in. The wear and tear of parts and incorrect handling of the antenna may also cause, in addition to the need to replace parts, deterioration of the reliability of the mobile station.

Helix antenna is a conductor wound into a right-hand or left-hand coil placed above a conductive plane. The helix structure provides a shorter antenna than the monopole structure when the operating frequency range is the same. A known prior-art implementation of the helix antenna in mobile stations is such that the antenna conductor is placed inside a protective cylindrical or conical piece of insulating material which is further attached to the mobile station by means of a connector. This connector also provides an electrical coupling between the antenna and the radio part of the mobile station. Also this structure, being placed outside the mobile station, is susceptible to damage caused e.g. by dropping the mobile station, as well as to other external impacts.

Since an external antenna in a mobile station is susceptible to damage, the antenna itself and the attachment of the antenna to the mobile station have to be made durable and strong, which may impede the attempt to achieve the optimum electrical characteristics for the mobile station and, above all, increase the price of the antenna. As regards to the assembly work of the mobile station, an external antenna structure means more work stages and, therefore, increases the cost of the assembly work. The antenna also has to be suitable for mass production, which means that the connections between the parts of the mobile station and the different parts of the antenna have to be suitable for automatic assembly.

Particularly with small hand-held phones the external antenna may be situated near the user's head when he is using the phone, which affects the electrical operation of the antenna. Likewise, part of the electrical energy radiated by the antenna may be coupled to the user's head. To reduce that coupled power the external antenna has to be placed in such a manner that it is as far away as possible from the user's head when the mobile station is in the operating position. This also results in some limitations to the design of the mobile station.

An antenna known to avoid some of the disadvantages of the external antenna is the air-insulated planar inverted F antenna (abbr. PIFA).

The PIFA antenna comprises a thin parallelogram-shaped antenna plate made of a conductive material such as metal or a plate coated with a conductive material. The lengths of the sides of the PIFA antenna depend on the operating frequency range of the antenna. When the operating frequency range is about 880 to 960 MHz, suitable dimensions of the PIFA plate are about 50 mm for the long sides and 25 mm for the short sides. The dimensions of the antenna plate are proportional to the wavelength of the operating frequency range. The usable frequency band can also be made wider with a PIFA antenna than with a helix antenna. Then it is also easier to manufacture the PIFA antenna such that the manufacturing tolerances are sufficient to guarantee the desired electrical operation.

In the PIFA, the antenna plate is placed substantially parallel to and at a distance from the structure serving as the earth plane. The earth plane may be e.g. an at least partly conductive protective body inside the mobile station. One short side of the antenna plate is short-circuited to the earth plane by means of a conductor, and a radio-frequency signal is fed to the antenna plate via an electric circuit having a capacitance and inductance connected in series. The capacitance and inductance constitute a series-resonant circuit the resonating frequency of which is dimensioned according to the operating frequency range of the mobile station, which is about 880 to 960 MHz, for example. The signal feed point on the antenna plate may be located at the short side of the plate, near the short circuit. The capacitance in the series-resonant circuit is located e.g. in the radio part of the mobile station and the inductance is coupled between the antenna plate and the radio part.

The frequency band of the antenna also depends on the distance between the earth plane and the different elements of the antenna plate, so that if the antenna plate is moved, the frequency band of the antenna is shifted aside from the desired frequency range. In order to prevent this, the antenna plate has to be securely attached to a base. In the assembly phase of the mobile station the antenna plate has to be attached precisely at the correct distance from the earth plane. The attachment shall prevent the antenna plate from moving with respect to the earth plane both along the plane of the antenna plate and along the direction perpendicular to that plane.

SUMMARY OF THE INVENTION

An object of this invention is to eliminate aforementioned disadvantages of prior-art antenna structures in mobile stations and to provide an antenna for a mobile station, which antenna is, as regards the manufacture of the different parts of the antenna, as simple as possible and, as regards the assembly of the mobile station, as easily assembled and as reliable as possible. The antenna advantageously comprises a PIFA antenna. The antenna according to the invention is characterized by an internal antenna for a handportable communication device having attachment means such as a cover structure and a support frame or spacers for bracing a narrow antenna plate therebetween, spaced at a fixed distance from the earth plane. The mobile station according to the invention is characterized by the incorporation of an internal antenna of the aforementioned type.

The antenna in question has considerable advantages. Using this antenna, the antenna can be placed inside the outer case of the mobile station so that the antenna is well protected inside the case and faults caused by dropping the mobile station and breaking the external antenna can be avoided. Thanks to the PIFA antenna, the weight of the mobile station can be reduced. The PIFA antenna is also simple so that, as regards to the antenna, automatic manufacture and assembly can be applied in the manufacture and production of the mobile station. Furthermore, a fact that adds to the reliability of the mobile station is that there is no need in the PIFA antenna for parts which during operation move with respect to each other, and thus wear out. The electrical coupling of the PIFA antenna to an internal printed circuit board can also be realised without big and strong connectors.

The antenna of the invention makes it possible to reduce the number of work stages in the assembly and at the same time enables accurate positioning of the antenna with respect to the earth plane, which is essential for the operation of the mobile station. The structure of the antenna also prevents the antenna plate from being supported by other parts of the antenna, so that external impacts such as bumps, changes of position and movements of the mobile station do not alter the dimensioning of the antenna as far as electrical operation is concerned. As regards to the assembly of the mobile station, the antenna according to the invention is reliable and easy to install, thereby being suitable for mass production.

The small size of the antenna and its adaptability to varying shapes of mobile stations enable easy lay-out design. The antenna can be positioned such that during operation it is located at the rear side of the mobile station with respect to the user, which means that compared to an external antenna, considerably less power is coupled to the user's head. At the same time, the adverse effect of the head during operation on the electrical characteristics of the antenna is reduced.

The invention is described in more detail with reference to the drawings, in which

THE DRAWINGS

FIG. 1 shows an exploded view of the structure of the antenna according to a preferred embodiment of the invention, FIG. 2*a* shows a top view of an exemplary structure of the antenna plate panel used in the manufacture of the antenna plate according to a preferred embodiment of the invention, FIG. 2*b* shows a perspective view of the antenna plate according to a preferred embodiment of the invention, FIG. 2*c* shows a perspective view of the structure of the support frame according to a preferred embodiment of the invention, FIG. 2*d* shows a simplified cross section of the antenna according to a first embodiment of the invention, wherein the antenna is in operating position, ie. installed in a mobile station, FIG. 3 shows a simplified diagram of a feed circuit of the antenna, FIG. 4 shows an exploded view of the structure of the antenna according to a second preferred embodiment of the invention, and FIG. 5 shows a simplified cross section of yet another advantageous antenna according to the invention, wherein the antenna is installed in a mobile station.

DETAILED DESCRIPTION

Figure 1:
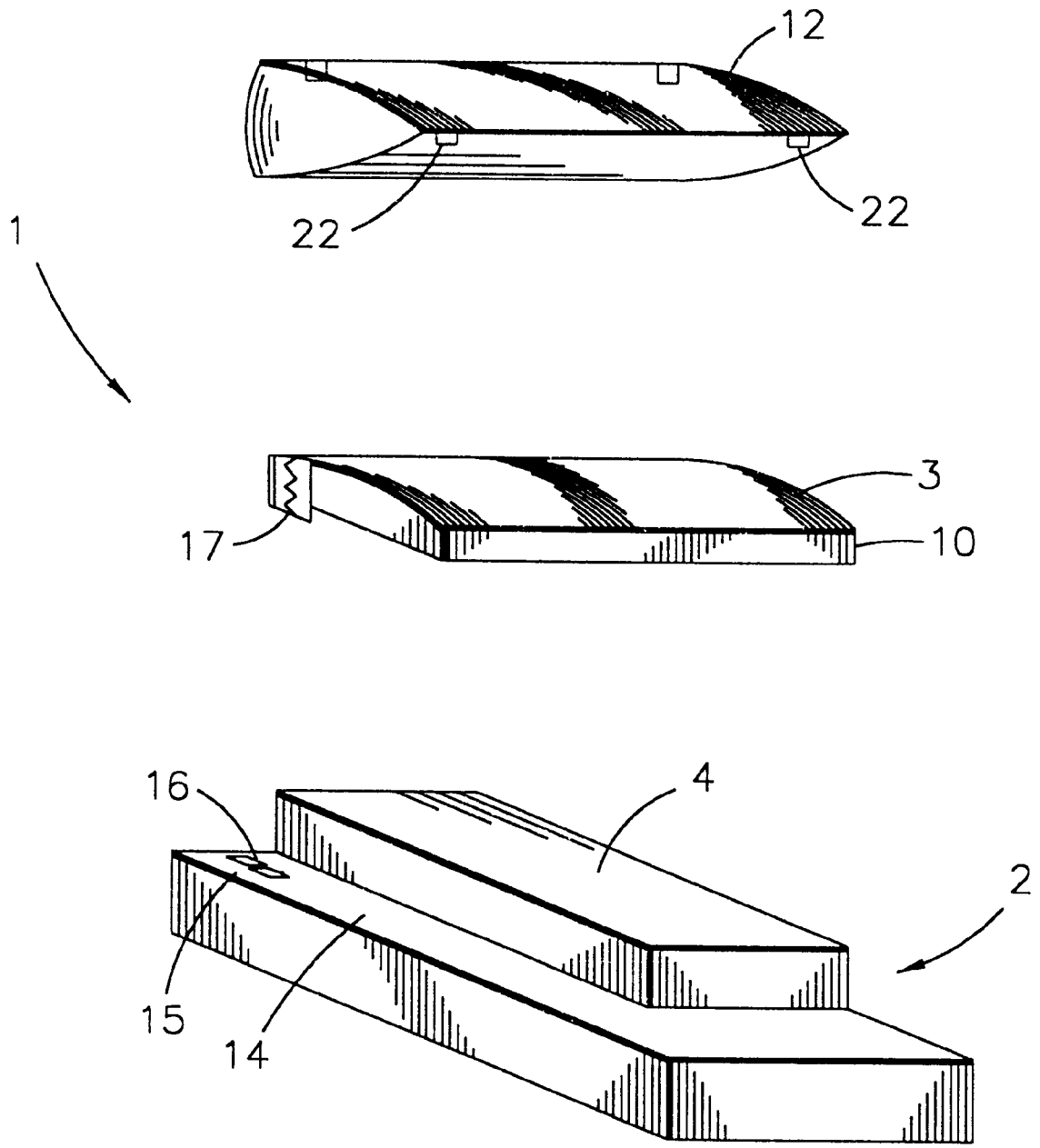
Figure 3:
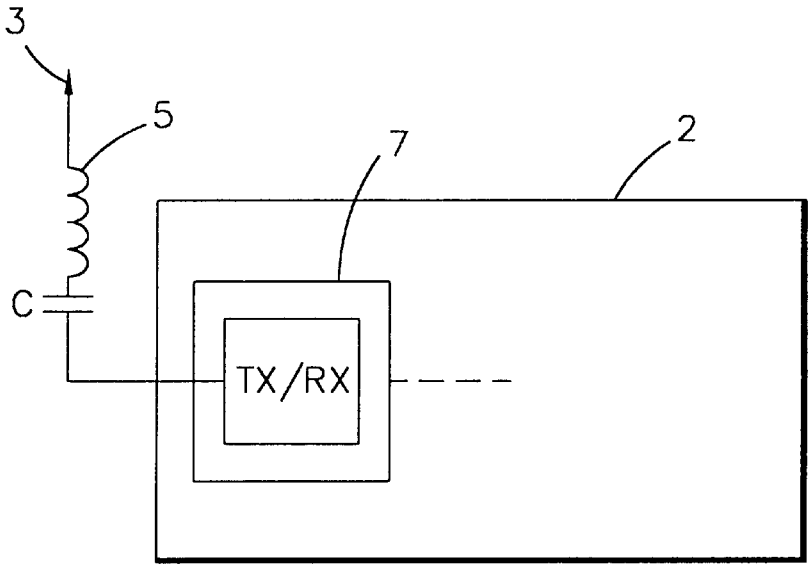

FIG. 1 shows a preferred embodiment of the antenna 1 according to the invention in connection with a wireless communications device such as a mobile station 2. The antenna 1 comprises an antenna plate 3 functioning as a planar radiator. The mobile station 2 comprises an earth plane 4 advantageously consisting of an electromagnetic compatibility (EMC) shield of the mobile station the task of which is to prevent interference signals possibly generated by the mobile station 2 from spreading into the environment and, on the other hand, interference signals coming from the environment from affecting the operation of the mobile station 2. The radio-frequency signal feed is arranged by means of a feed element 5 coupled between the antenna plate 3 and the radio part 7 (FIG. 3). The antenna plate 3 is short-circuited to the earth plane 4 through an earthing element 6 so that electrically the antenna 1 is a quarter-wavelength antenna. The feed element 5 is advantageously an inductance and the earthing element 6 is a conductor electrically connected to both the antenna plate 3 and earth plane 4 when the antenna plate is installed in its place.

Figure 2A:
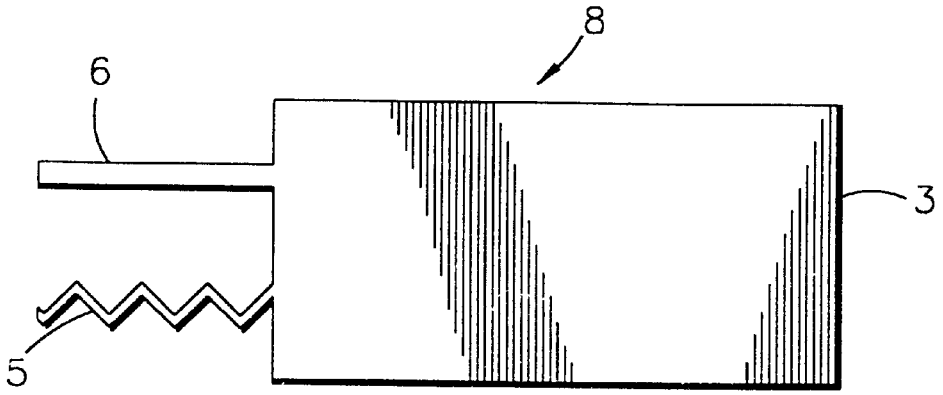
Figure 2B:
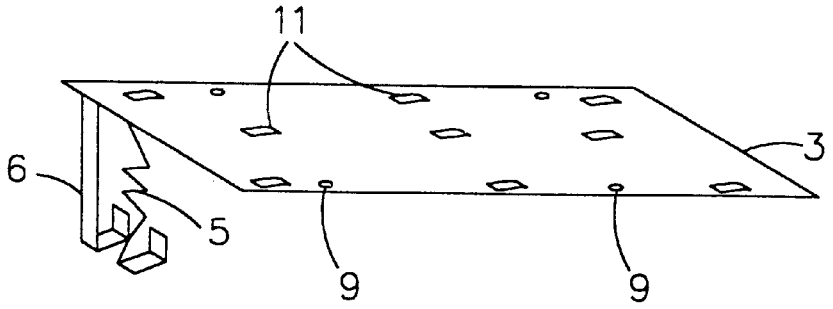

FIG. 2*a* shows in more detail an antenna plate panel 8 for the antenna 1 shown in FIG. 1, and FIG. 2*b* shows an antenna plate 3 made from the antenna plate panel 8. The antenna plate panel 8 is preferably a flexible, thin metal plate or an electrically conductive plate, such as a plate coated with a conductive material. The antenna plate 3 functioning as an radiator is planar and advantageously shaped like a parallelogram or polygon. In order to position the antenna plate 3 accurately to a support frame 10 guide holes 9 have been punched or drilled on the antenna plate which are small as compared to the dimensions of the antenna plate 3. In this preferred embodiment illustrated by FIG. 2*a* the antenna 1 also comprises a feed element 5 made from the same panel and preferably at the same time as the antenna plate 3 by means of punching or other suitable work method, and an earthing element 6. The feed element 5 is realised using a stepped metal strip in which the lengths of the steps and the width of the strip at each step depend on the desired electrical operation. Operation of the feed element 5 in connection with the operation of the antenna 1 corresponds to an inductance and the magnitude of the inductance depends on the dimensions and operating frequency range of the feed element 5. The structural length of the earthing element 6 and feed element 5 at least equals the distance of their point of attachment in the antenna plate 3 from the corresponding point of attachment in the radio part 7 of the mobile station, depicted in FIG. 1 by a signal conductor interface 15 and earth conductor interface 16 formed in the conductive layer of the printed circuit board 14A.

The distance of the antenna plate 3 from the earth plane 4 can be different at different parts of the antenna plate 3. The antenna plate may be curved, for example, as shown in the drawing. The curvature corresponds to the shape of the cover structure 12 so that the cover structure 12 supports the antenna plate 3 evenly. Obviously, the nearer the antenna plate 3 and the earth plane 4 are to each other, the greater the capacitance between them. This decreases the resonating frequency of the antenna 1 to a certain extent, which has to be taken into account when dimensioning the antenna plate 3 for the desired operating frequency range.

In this embodiment the antenna plate 3 also comprises spring elements 11 made from the antenna plate panel 8 by means of punching and bending, for example, and attached by one side to said antenna plate. The purpose of the spring elements 11 is to brace the antenna plate against the surface of the inner side of the antenna cover structure 12 so as to accurately press the flexible antenna plate 3 to the support frame 10 in order to make sure that the distance of the antenna plate 3 from the earth plane 4 is correct.

It is obvious that the shape of the antenna plate 3 may be different from the shape of a parallelogram and from planar form so that its positioning in the apparatus has more alternatives. Similarly, the number and positioning of the spring elements 11 depend on the structure of the support frame 10, among other things. And, as far as electrical operation is concerned, the earthing element 6 can be replaced by a separate metal earthing conductor and the feed element 5 by a separate metal feed conductor which, wound into a coil, corresponds in its electrical operation to an inductor. An radiator can also be produced by using as an antenna plate 3 a molded or cast plastic sheet coated with an electrically conductive material or formed by mixing an electrically conductive substance in a plastic raw material, for example.

The antenna 1 according to the invention can also be realised without an earting element 6, but then the radiator necessarily increases in size.

Figure 2C:
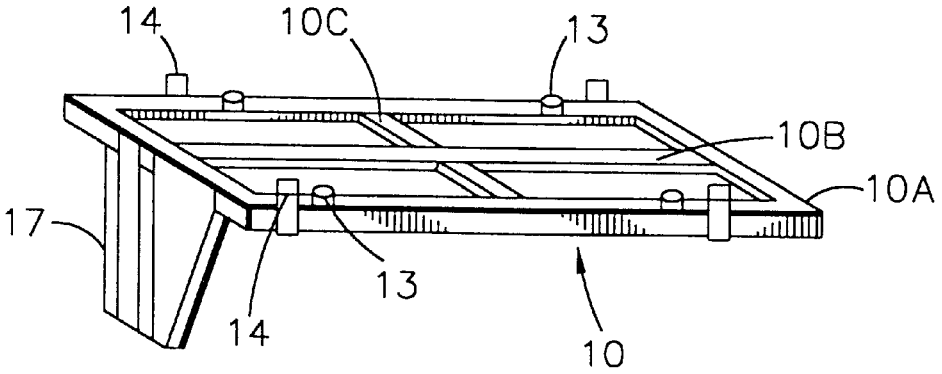

An advantageous implementation of the antenna support frame 10 shown in FIG. 2*c* comprises a planar outer frame 10*a* made e.g. of plastic by means of casting, and, connected to it, a support structure 10*b*, 10*c*. The support frame 10 is made of a material which is an electrical insulator. The thickness of the support frame 10 may vary in different places. The shape of the outermost edge of the continuous outer frame 10*a* in the support frame 10 advantageously follows the shape of the antenna plate 3 supported by it.

The support frame 10 comprises guide pins 13 attached to its outer frame 10*a* or its support structure 10*b*, 10*c* such that said pins are substantially perpendicular to the plane of the support frame 10. The guide pins 13 are placed on the support frame such that in the assembly of the antenna 1 the guide pins 13 meet the guide holes 9 at the corresponding locations in the antenna plate 3 and fasten it to the support frame 10 along the main plane of the antenna plate 3. The support frame's outer frame 10*a* or its support structure 10*b*, 10*c* comprises preferably flexible locking elements 14 located in the support frame preferably at positions corresponding to the outer edges of the antenna plate 3, advantageously in such a manner that the edge of the antenna plate 3 is braced by them. The purpose of the locking elements 14 is to lock the support frame 10 to the antenna cover structure 12. This is achieved e.g. by arranging in each locking element 14 a tooth or another clawlike part which in the operating position meets its counterpart (not shown), such as a groove, in the cover structure 12. The flexible structure of the locking elements 14 facilitates that the clawlike part is pushed aside and returns when the support frame 10 is installed in the cover structure 12. This has e.g. the advantage that the antenna plate 3 is quickly installed and yet the antenna plate 3 can be accurately positioned with respect to the support frame 10 and, thus, with respect to the earth plane 4. The cover structure 12 preferably comprises flexible counterparts 22 which are pushed against the surface of the antenna plate 3 when the antenna plate 3 is installed.

The support frame in FIG. 2*c* also includes for the feed element 5 and earthing element 6 a support base 17 against which the feed element 5 and earthing element 6 formed from the antenna plate panel 8 are placed when the antenna plate 3 is installed.

Figure 2D:
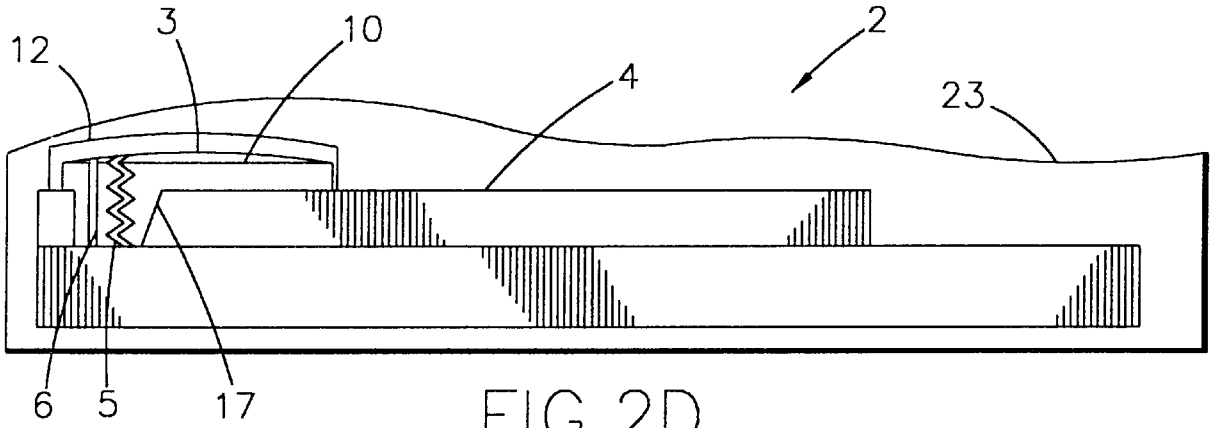

The antenna 1 described above is attached to a mobile station 2 advantageously by attaching the cover structure 12 with the aforementioned structural parts of the antenna 1 e.g. by means of screws or using some other known method of attachment to the case 23 or printed circuit board 14A of the mobile station. FIG. 2*d* presents a simplified cross section of the antenna 1 according to a first embodiment of the invention in the operating position, ie. installed in a mobile station 2.

By way of example, dimensions are provided for the antenna 1 of FIG. 1 to be used in a mobile station 2 of the GSM mobile communications system. The frequency range is about 880 to 960 MHz, which corresponds to wavelengths of about 34 to 31 cm. The size of the antenna plate 3 is about 5×2.5 cm and the distance from the earth plane about 2 mm at a first edge and somewhat greater at a second edge. The length of the earthing conductor 6 is about 11.5 mm and it is connected to a comer of the antenna plate 3. The feed element 5 is connected at about 4 mm from the connection point of the earthing conductor 6, at a distance of about 2 mm from the edge of the antenna plate.

Figure 5:
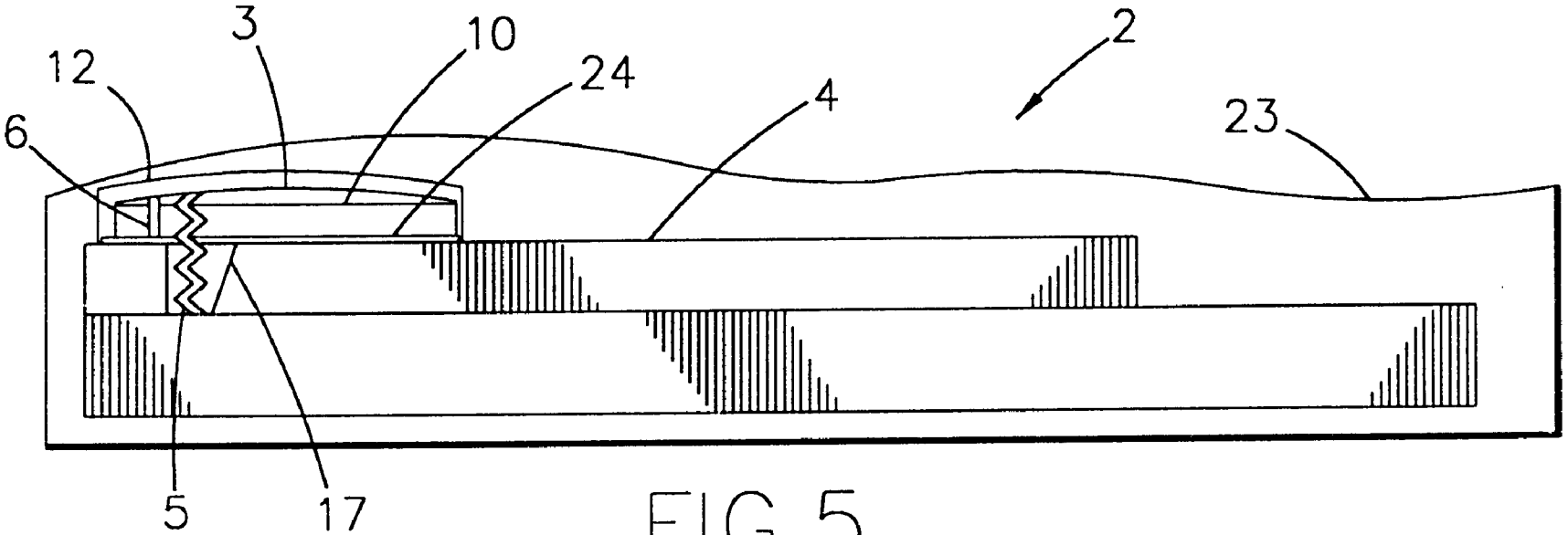

The earthing conductor 6 can also be realised such that it is coupled directly to the earth plane 4, in which case about 2 mm is a sufficient length for the earthing conductor in the dimensioning example above. The contact between the earthing conductor 6 and earth plane 4 can be realised by means of compression, for example. A further method of implementation is that a capacitive plate 24, ie. an electrically conductive plate electrically insulated from the earth plane 4, is placed on top of the earth plane 4. Then the capacitive plate 24 and earth plane 4 form a capacitance so that high-frequency signals are short-circuited between the capacitive plate 24 and earth plane 4. This arrangement is illustrated in a simplified manner in the cross section of FIG. 5.

FIG. 3 shows an example of a feed circuit for the antenna 1 according to the invention, comprising a radio part 7 of a mobile station, said radio part comprising, among other things, a transmitter/receiver TX/RX and an matching capacitance C. The matching capacitance C and the inductance used as an antenna feed element 5 constitute a series-resonant circuit preferably tuned to the operating frequency range of the antenna 1, thus increasing the bandwidth of the antenna 1.

Figure 4:
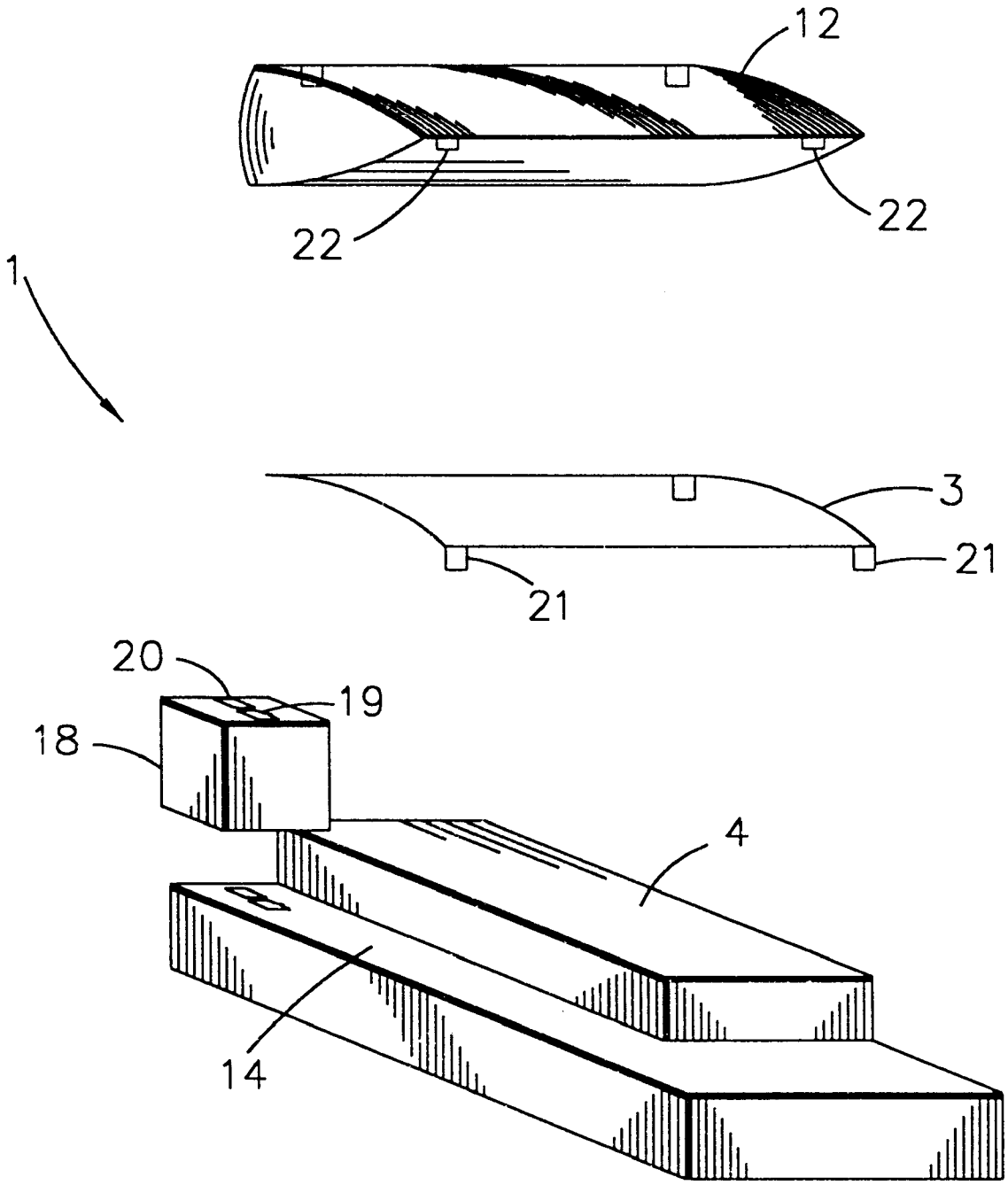

FIG. 4 shows an exploded view of the antenna 1 according to a second preferred embodiment of the invention. This differs from the embodiment depicted in FIG. 1 e.g. in that the feed element 5 and earthing element 6 are implemented in a separate feed module 18 which can be attached by means of soldering, for instance, to the signal conductor interface 15 and earthing conductor interface 16 on the printed circuit board 14 in the mobile station. An advantageously opposite surface of the feed module 18 has contacts 19, 20 which connect the feed element 5 and earthing element 6 to the antenna plate 3 in the operating position. This embodiment does not include a support frame 10 proper, but the antenna plate has intermediate supports 21 by means of which the distance of the antenna plate 3 from the earth plane 4 is kept right. In this embodiment, installation is carried out directly to the mobile station 2, first attaching the feed module 18, then placing the antenna plate 3 at the right spot above the earth plane 4. On top of the antenna plate 3 it is placed a cover structure 12 which has preferably flexible protrusions 22 by means of which the antenna plate 3 is pressed against the earth plane 4 of the mobile station. Then the antenna plate 3 is held securely in its place in spite of possible impacts and other external forces directed to the mobile station 2.

It is obvious that the positioning and number of guide pins 13 and locking elements 14 in the support frame may vary according to the application in question. The locking elements may also be located in the support frame in such a manner that they penetrate the antenna plate through holes in it. The locking and guiding functions can also be combined e.g. by forming in the guide pins 13 a claw or the like which serves as a locking element 14. The locking of the support frame 10 to the cover structure 12 can also be arranged using other attaching elements, such as screws or adhesives.

The antenna cover structure 12 shown in the drawing is advantageously a parallelogram-shaped piece made by casting from a plastic material and having a convex outer surface. The concave inner surface of the cover structure 12 has recesses (not shown) made by drilling or in conjunction with the casting. The recesses are located in the cover structure 12 at locations corresponding to those of the support frame's guide pins 13 when the antenna is fully assembled. The function of the recesses is to align the support frame 10 with respect to the cover structure 12. The concave inner surface of the cover structure 12 also includes locking grooves made by drilling or in conjunction with the casting which are located at locations corresponding to those of the support frame's locking elements 14 so that the support frame 10 can be locked to the cover structure 12.

It is obvious that the shape of the cover structure's 12 edge and the convexity of the outer side may vary greatly according to the components in the immediate vicinity of which the antenna 1 is attached in the mobile station 2. Likewise, the cover structure 12 may comprise one or more holes for the attachment of the antenna 1 to the mobile station 2 by means of screws. The cover structure 12 may also have, attached to the collar or edge part, one or more locking elements 14 the purpose of which is to attach to edge locking grooves located at the corresponding locations in the mobile station 2. The attachment of the cover structure 12 secures the correct distance of the antenna plate 3 from the antenna earth plane 4.

The simple structure of the antenna 1 is a considerable advantage in the assembly work. The antenna plate is aligned with the frame structure by means of guide pins 13 and antenna plate guide holes 9, and the antenna plate 3 is formed according to the shape of the support frame 10. The support frame 10 with the antenna plate 3 is aligned with the inner surface of the cover structure 12 by means of guide pins 13 and recesses in the cover structure. The locking elements 14 in the support frame 10 are locked into edge locking grooves in the cover structure 12. Spring elements 11 on the antenna plate 3 are pressed against the inner side of the cover structure 12 and thus push the antenna plate 3 accurately against the support frame 10. The compressive effect can be enhanced by placing on the inner surface of the cover structure 12 counterparts 22 made of a flexible material.

The structure of the antenna 1 according to the invention was above described in conjunction with a mobile station 2, but it is also applicable to other wireless communications devices that use radio-frequency signals in their communications. Such devices include radio telephones and cordless telephones, for example.

The present invention is not limited to the embodiments described above but the invention can be applied within the spirit and scope defined by the claims set forth below.

We claim:

1. An internal antenna (1) for a wireless handportable communications device (2) comprising:

a narrow antenna plate (3) functioning as a radiator which radiates from the back of the device (2), a feed element (5) to feed the radiator (3) from an upper corner area thereof to provide vertical polarization performance from the antenna, and attachment elements (10, 12) to attach the antenna (1) to a wireless communications device (2), which comprises a single electrically conductive earth plane (4), characterized in that the attachment elements (10, 12) comprise a cover structure (12) having flexible extension means (22) for contacting and bracing the antenna plate (3) on the wireless communications device (2), and that the antenna (1) further comprises means (10, 21) for keeping the antenna plate (3) at a distance from the earth plane (4).

2. The antenna (1) of claim 1 which comprises an earthing element (6), characterized in that the feed element (5) and earthing element (6) are internal parts of an antenna plate panel (8) forming the antenna plate (3).

3. The antenna (1) of claim 2, characterized in that the means (10, 21) for keeping the antenna plate (3) at a distance from the earth plane (4) comprises a support frame (10) on top of which the antenna plate (3) is placed and which includes means (14) for attaching the support frame (10) to the cover structure (12) to brace the antenna plate therebetween.

4. The antenna (1) of claim 3, characterized in that the support frame (10) comprises means (13) for guiding the antenna plate (3) into its correct location with respect to the support frame (10) when the antenna (1) is assembled.

5. The antenna of claim 1, characterized in that the means (10, 21) for keeping the antenna plate (3) at a distance from the earth plane (4) comprises intermediate supports (21) connected to the antenna plate (3).

6. The antenna of claim 5 which comprises an earthing element (6), characterized in that the feed element (5) and earthing element (6) are realised in a separate feed module (18) which comprises means (19, 20) for electrically coupling the feed module (18) to the antenna plate (3).

7. The antenna of claim 1, characterized in that the means (10, 21) for keeping the antenna plate (3) at a distance from the earth plane (4) is included in the cover structure (12).

8. The antenna of claim 1, characterized in that it comprises a matching capacitance, which forms a series resonant feed circuit together with the inductance of the antenna feed element as an inductance and a matching capacitance.

9. The antenna of claim 8, characterized in that the feed circuit is tuned to the operating frequency range of the antenna, thus increasing the bandwidth of the antenna.

10. A mobile handportable station (2) comprising:

a radio part (7), an earth plane (4), an antenna (1) which comprises a narrow antenna plate (3) functioning as a radiator which radiates from the back of the station (2) and a feed element (5) at an upper corner area thereof to provide vertical polarization performance from the antenna, for conducting a radio-frequency signal between the antenna plate (3) and radio part (7), and attachment elements (10, 12) for attaching the antenna (1) to a mobile station (2), characterized in that the attachment elements (10, 12) comprise a cover structure (12) having flexible extension means (22) for contacting and bracing the antenna plate (3) on the mobile station (2), and that the antenna (1) further comprises means (10, 21) for keeping the antenna plate (3) at a distance from the earth plane (4).

* * * * *